US006502309B2

(12) United States Patent
De Vries et al.

(10) Patent No.: US 6,502,309 B2
(45) Date of Patent: Jan. 7, 2003

(54) SHAVING APPARATUS

(75) Inventors: Tjamme De Vries, Drachten (NL); Albert Jan Aitink, Drachten (NL); Marcel Adriaansen, Drachten (NL); Fokke Roelof Voorhorst, Drachten (NL); Simon Eme Kadijk, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/862,279

(22) Filed: May 22, 2001

(65) Prior Publication Data

US 2002/0014011 A1 Feb. 7, 2002

(30) Foreign Application Priority Data

May 23, 2000 (EP) ..... 00201834

(51) Int. Cl.[7] ..... B26B 19/14

(52) U.S. Cl. ..... 30/34.2; 30/43.6; 76/104.1; 76/115

(58) Field of Search ..... 30/34.2, 43.6, 30/346.51; 76/104.1, 115

(56) References Cited

U.S. PATENT DOCUMENTS 4,258,470 A * 3/1981 Boiten et al. ..... 30/34.2 X
4,275,497 A * 6/1981 Engelhardt et al. ..... 30/34.2 X
4,545,120 A * 10/1985 De Vries ..... 30/34.2
4,630,370 A * 12/1986 Hamada ..... 76/104.1 X

FOREIGN PATENT DOCUMENTS

GB 2036629 A 7/1980

* cited by examiner

*Primary Examiner*—Douglas D. Watts
(74) *Attorney, Agent, or Firm*—Ernestine C. Bartlett

(57) ABSTRACT

Method of manufacturing a blade-shaped hair-pulling element (13) for a cutting unit (3) of a shaver. The shaver comprises a plurality of cutter elements (8) and a corresponding plurality of hair-pulling elements (13) each arranged in front of one of the cutter elements for movement therewith relative to an outer cutting member (4) and each slidable on the inner cutter element so as to be movable relative thereto for its hair-pulling action. In order to increase the distance over which the hairs are pulled up, an end portion (22) of each hair-pulling element (13) has an enlarged thickness. The hair-pulling element is obtained by means of a process of shaping the outline (stamping, etching, laser) followed by a bending process. The method to obtain the thickened end part (20) is characterized in that during the process of shaping the outline, the hair-pulling element is provided with a tab (23) which in a following bending process is bent against the end portion (22) of the hair-pulling element.

4 Claims, 5 Drawing Sheets

SHAVING APPARATUS

Figure 1:
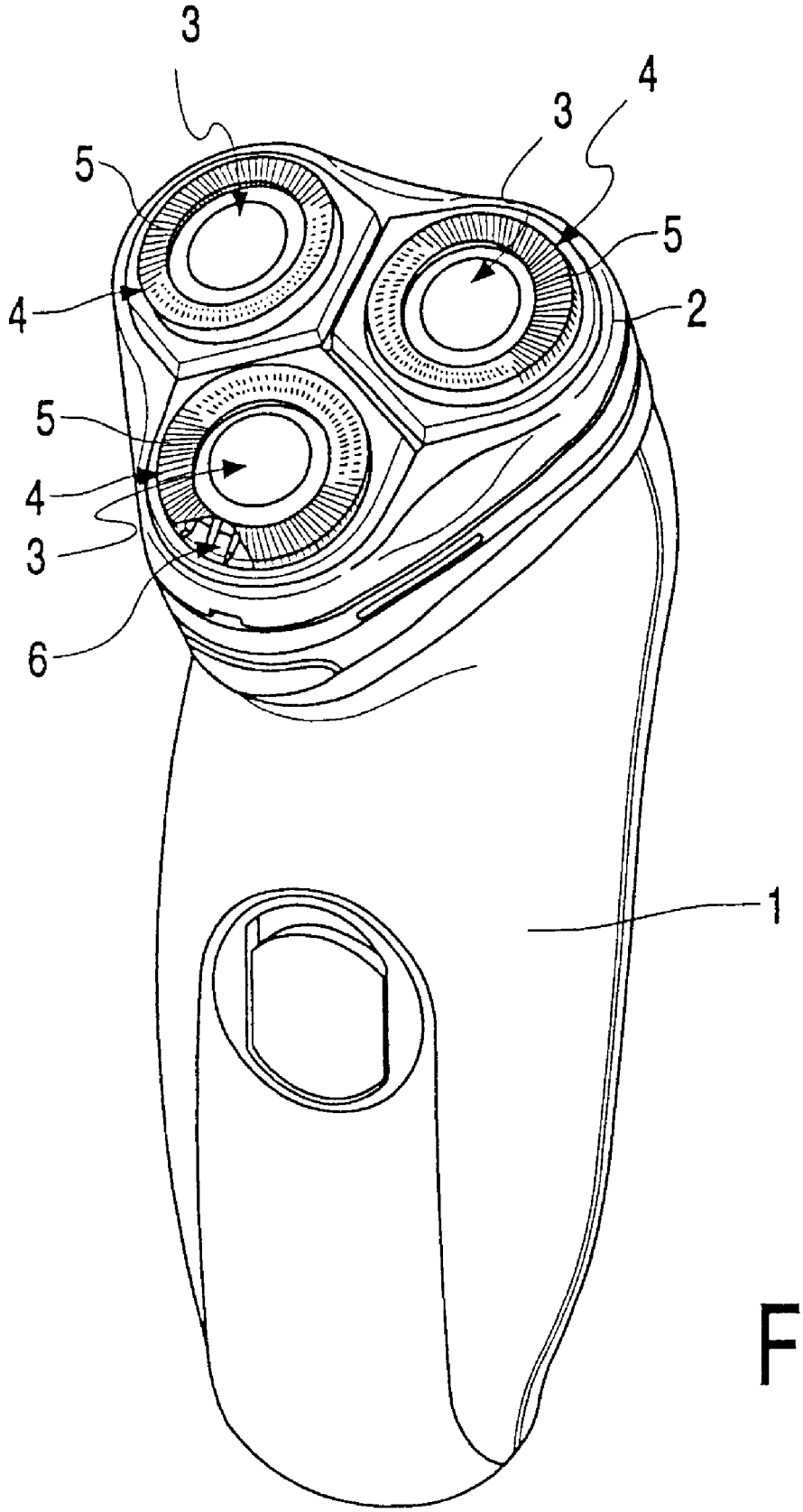

The invention relates to a method of manufacturing a blade-shaped hair-pulling element for a cutting unit of a shaving apparatus, which cutting unit is provided with an external cutting member and an internal cutting member which can be driven with respect to the former member, said internal cutting member having cutter elements which are provided with cutting edges, while said external cutting member is provided with a wall portion with hair-trapping openings which are bounded by counter cutting edges for cooperation with the cutting edges of the drivable cutter elements, each cutting element being provided with the hair-pulling element which is in front position, as seen in the drive direction, and which is movable relative to the associated cutter element during operation of the shaving apparatus from and towards the wall portion of the external cutting member, while each hair-pulling element is provided with a thickened end with an edge which during operation of the shaving apparatus comes into contact with a hair projecting through the hair-trapping opening and pulls this hair further through the hair-trapping opening before said hair is cut off through the cooperation of the cutting edge and the counter cutting edge, said blade-shaped hair-pulling element being obtained by means of a process of shaping its outline followed by a bending process.

An example of the shaving apparatus described above is known from GB-A-2036629. During shaving, the edge of the hair-pulling element penetrates the hair somewhat, but without cutting it through. Since the hair-pulling element is movable relative to the accompanying cutter element, a pulling force will be exerted on the hair as a result of which the hair will pass farther into the hair-trapping opening, inter alia owing to the natural elasticity of the skin. This continues until the cutting edge of the cutter element hits against the hair, whereupon the cooperation between the moving cutting edge and the stationary counter cutting edge severs the hair. The hair is cut off closer to the skin as a result of this effect, and a better shaving result is obtained. The distance over which the hairs are pulled up is limited by the properties of the hairs and the skin, and in particular by the shape and dimensions of the hair-pulling elements. Thus the presence of a projecting portion of the hair-pulling element will increase the distance between the edge of the hair-pulling element and the cutting edge of the cutter element. This also increases the distance over which the hair is pulled into the hair-trapping opening, so that the hair can be cut off even closer to the skin. A hair-pulling element must be resilient, have a certain stiffness, and have a low mass if it is to function satisfactorily. After cutting of a hair, the hair-pulling element must return to its initial position as quickly as possible in order to be able to pull the next hair. Therefore, the hair-pulling element is constructed as a kind of thin blade spring. These thin, blade-shaped hair-pulling elements are obtained from a thin metal plate by means of a process of shaping the outline, and subsequently the hair-pulling elements thus obtained are given a desired shape in a bending process. A process of shaping the outline is to be understood to be, for example, a stamping process, a (laser) cutting process, or an etching process. A problem arises when a hair-pulling element is provided with a projecting portion. This projecting portion is depicted in GB-A-2036629 as a solid, integral part of the hair-pulling element, in fact in a rather theoretical manner so as to make it clear what the advantage of such a projecting portion is. It would be an obvious method to glue the projecting portion as an additional plate on the hair-pulling element. In practice, however, this is found to be unsatisfactory.

It is an object of the invention to provide the hair-pulling element of the shaving apparatus as defined in the opening paragraph with its thickened portion in a simple manner.

The invention is for this purpose characterized in that during the process of shaping the outline the blade-shaped hair-pulling element is provided with at least one tab which will subsequently lie against an end portion of the hair-pulling element as a result of a bending process, thus forming said thickened end.

Preferably, a narrow opening continuing up to said edge of the hair-pulling element is stamped out between an end portion of the hair-pulling element and the tab during the stamping process. The bending process to be performed subsequently will thus proceed with greater ease, smaller forces are required, and said edge will not be damaged at the area of the bend.

The invention also relates to a cutting unit provided with a hair-pulling element obtained by the method defined above, and to a shaving apparatus provided with said cutting unit.

The invention will now be explained in more detail with reference to an embodiment shown in a drawing.

Figure 2:
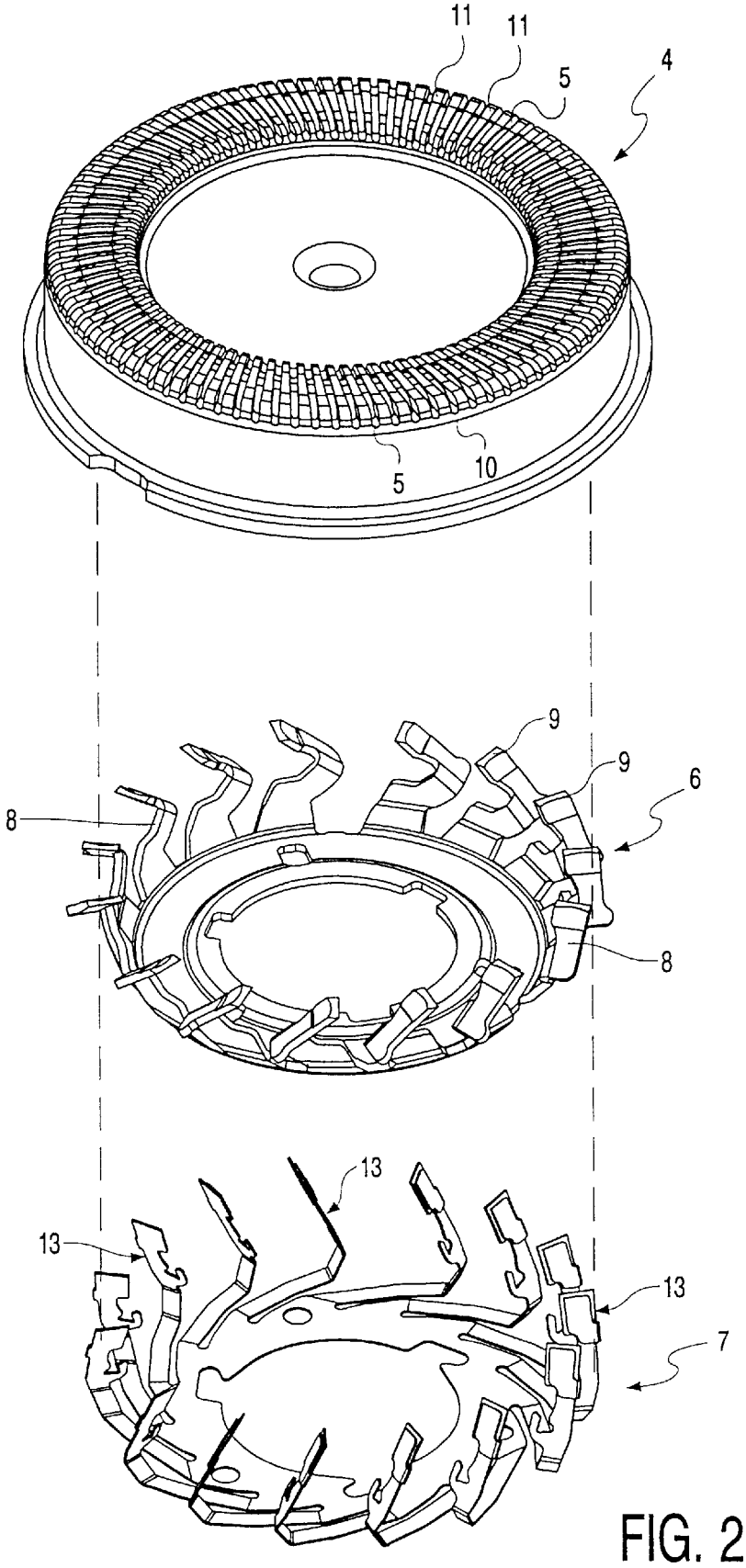
Figure 3:
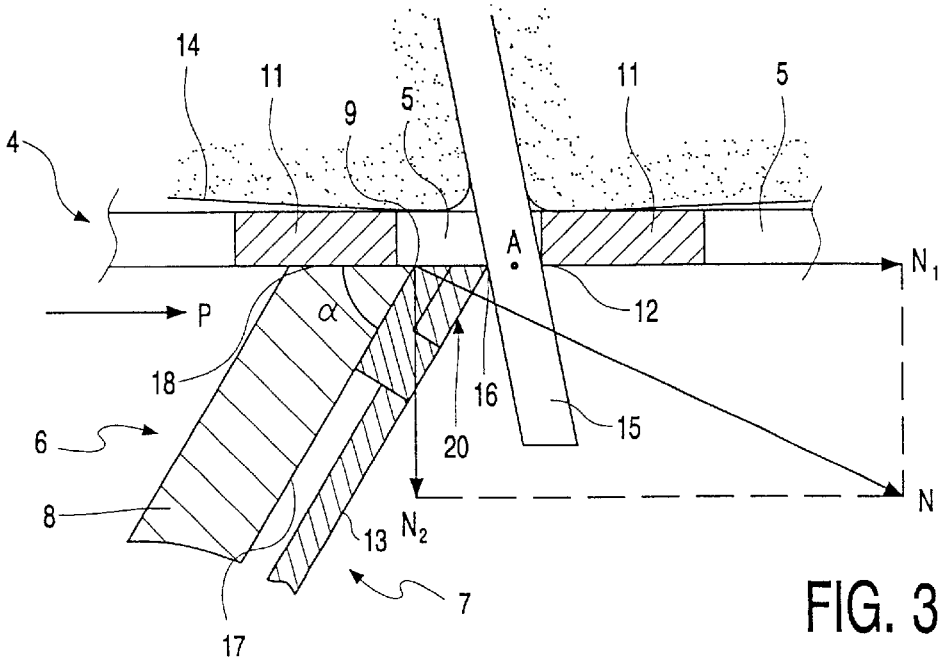
Figure 4:
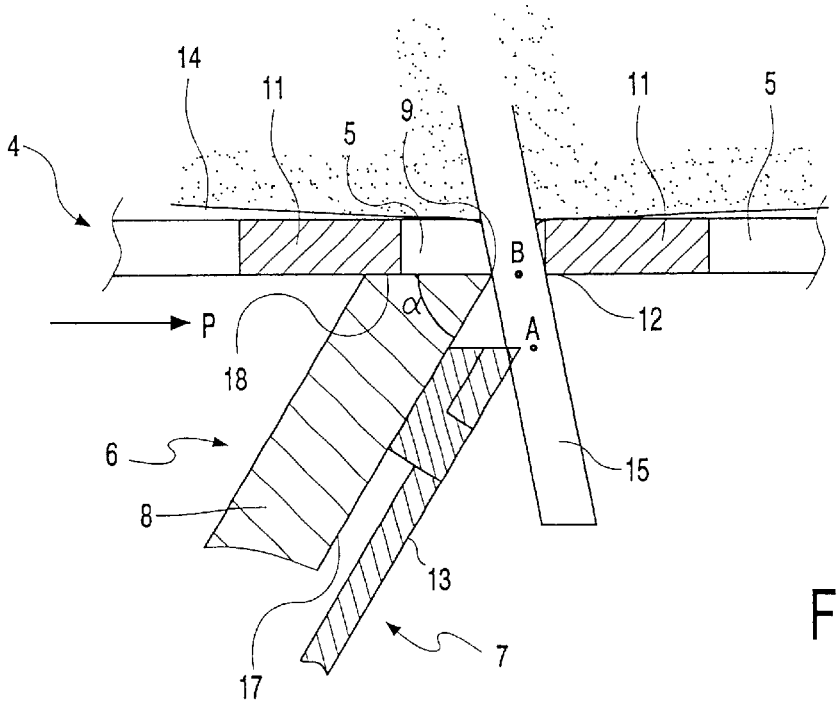
Figure 5:
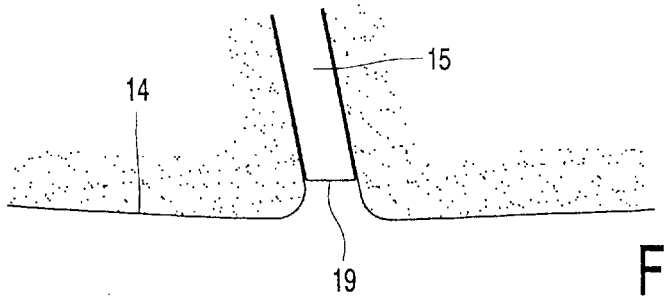
Figure 6:
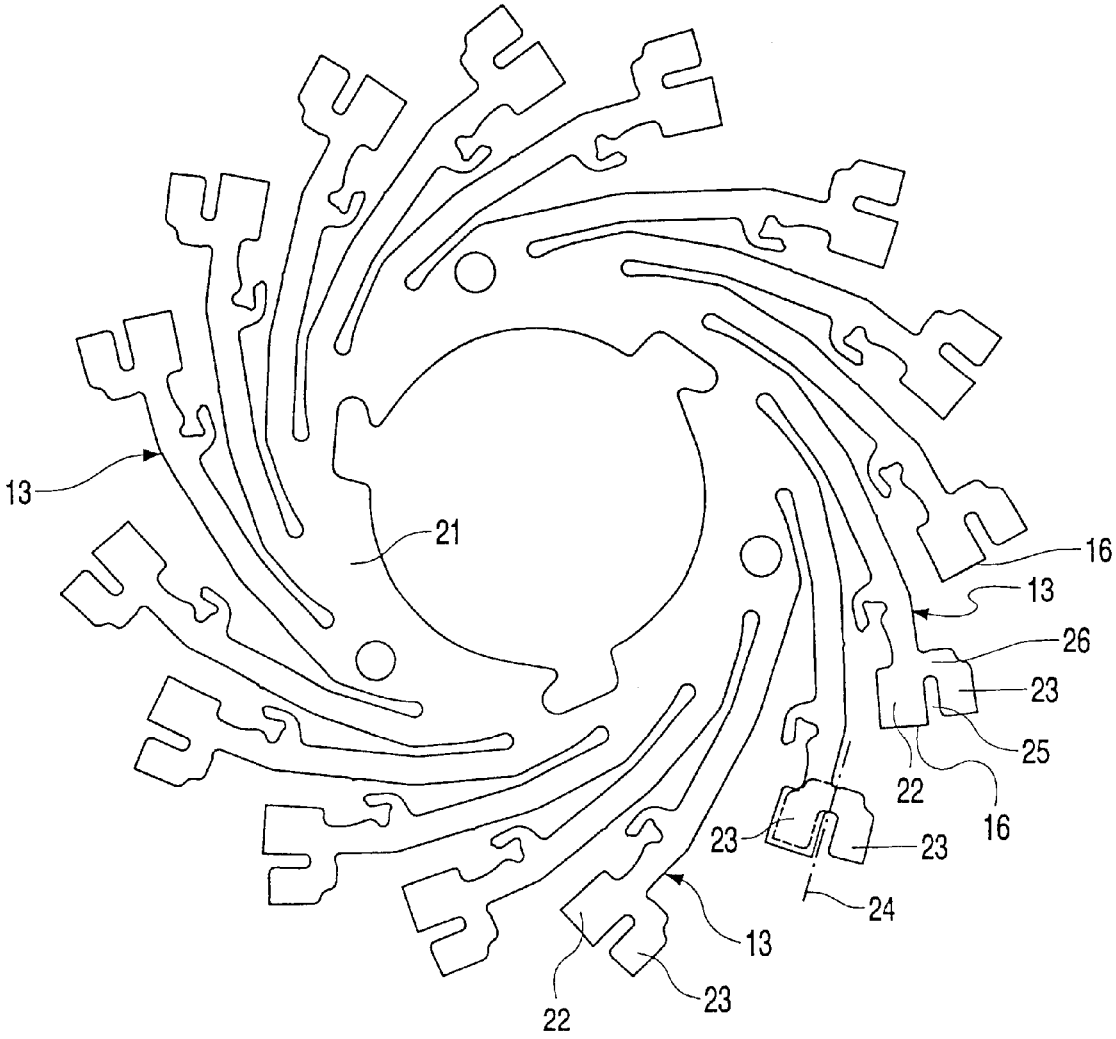
Figure 7:
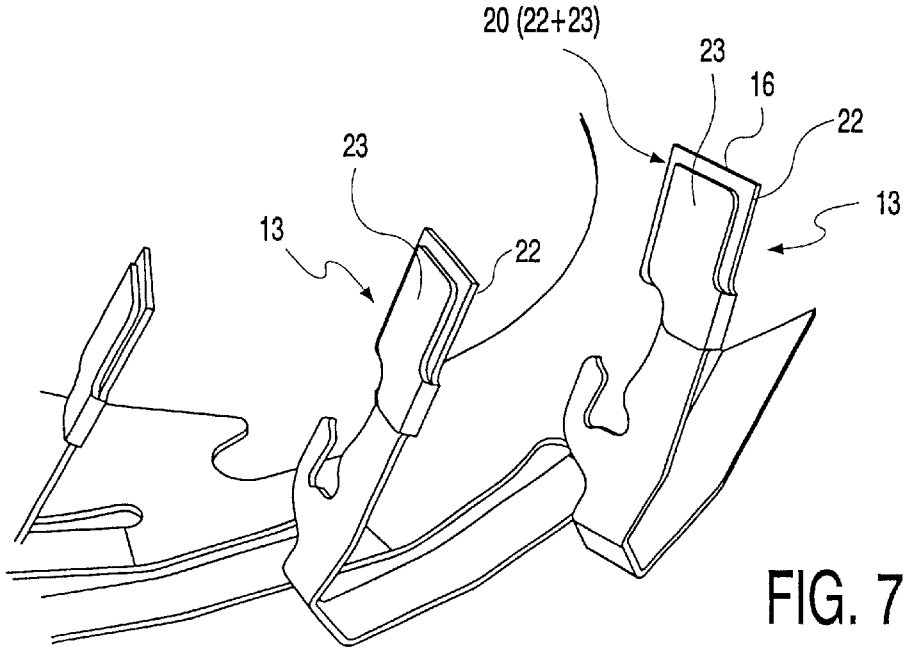
Figure 8:
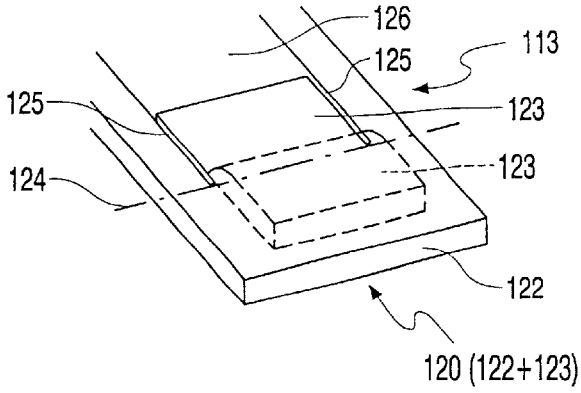
Figure 9:
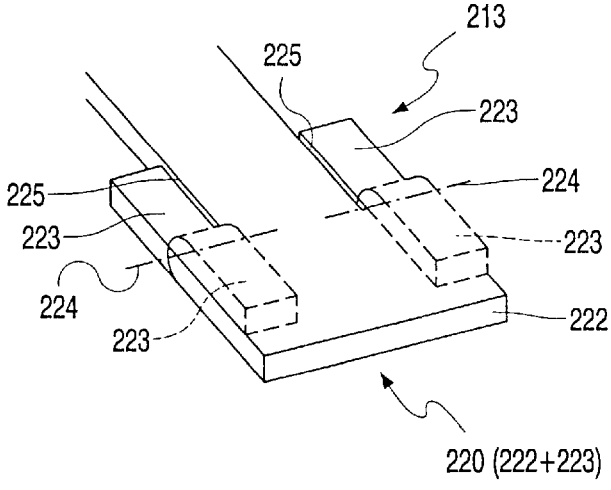

FIG. 1 shows a shaving apparatus with three cutting units in perspective view, FIG. 2 shows the components of a cutting unit in perspective view, FIGS. 3 and 4 diagrammatically show the principle of the cutting process, FIG. 5 shows a skin portion with a cut-off hair, FIG. 6 is a plan view of the blade-shaped hair-pulling element after the stamping process but before the bending process, FIG. 7 shows a detail of the hair-pulling element after the bending process, and FIGS. 8 and 9 show two more examples of a hair-pulling element.

FIG. 1 shows a rotary shaving apparatus with a housing 1 and a shaving head holder 2 which is detachable from the housing and/or which may be hinged to the housing. In the shaving head holder there are three cutting units 3, also called shaving heads, each comprising an external cutting member 4 with hair-trapping openings 5 and an internal hair cutting member 6 which can be driven into rotation with respect to the former member. The internal cutting members are driven by a motor present in the housing of the shaving apparatus in a known manner, said motor not being depicted in any detail.

FIG. 2 shows the three components of a cutting unit 3, i.e. the external cutting member 4, the internal cutting member 6, and a hair-pulling member 7. The internal cutting member 6 is a circular body which is provided with a number of cutter elements 8, each with a cutting edge 9 at the tip. The external cutting member 4, which has the shape of a circular cap, is provided with an annular wall portion 10 with a large number of slotted hair-trapping openings 5 which are substantially radially directed with respect to the center of the cap, between which openings lamellae 11 extend. Lower edges of the lamellae have counter cutting edges 12 which cooperate with the cutting edges 9 of the cutter elements 8 of the internal cutting member 6 (see FIG. 3) during operation of the shaving apparatus. The hair-pulling member 7 is also a circular body which is provided with a number of blade-shaped hair-pulling elements 13. The hair-pulling member 7 is fastened on the internal cutting member 6, one blade-shaped hair-pulling element 13 lying against each cutter element 8 such that, seen in the drive direction P of the internal cutting member, the hair-pulling element lies in front of the accompanying cutter element (see also FIGS. 3 and 4).

FIGS. 3 and 4 are diagrammatic cross-sectional views of a portion of the cutting unit 3 in which also the skin 14 with a hair 15 are depicted. The cutting process is as follows. When a hair 15 enters a hair-trapping opening 5, the rotary movement, indicated with arrow P, of the internal cutting member 6 together with the hair-pulling member 7 with respect to the external cutting member 4 will cause the contact edge 16 of the hair-pulling element 13 to come into contact with the hair 15 at a level A (see FIG. 3). The contact edge 16 is constructed as a sharp edge which will penetrate the hair 15 somewhat, but without cutting the hair through. The reaction force exerted by the hair 15 on the hair-pulling element 13 will be oppositely directed to the direction of movement P. This force will have to be compensated by a component $N_1$ of the perpendicular force N exerted by the guiding wall 17 of the cutter element 8 on the hair-pulling element 13. Small frictional forces between the cutter element and the hair-pulling element are disregarded here for simplicity's sake. The component $N_2$ of the perpendicular force N will have the result that the hair-pulling element 13 slides along the guiding wall 17. The angle $\alpha$ between the guiding wall 17 and the wall 18 of the cutter element 8, which bears on the external cutting member 4, will have to be smaller than 90°. The hair 15 will be taken along by the hair-pulling element 13, inter alia owing to the natural elasticity of the skin, until the cutting edge 9 of the cutter element 8 reaches the hair 15 at level B (see FIG. 4). The hair is thus pulled from the skin over a distance from A to B before the hair is severed at B through the cooperation between the cutting edge 9 and the counter cutting edge 12. Without the hair-pulling element, the hair 15 would be cut through at level A. It will be obvious that a hair can be cut off over a greater length, i.e. closer to the skin, thanks to the hair-pulling element. The cut end 19 of the hair will even lie below the skin level, as shown in FIG. 5, after cutting owing to a slight retraction of the hair caused by the natural elasticity of the skin.

As is evident in FIGS. 3 to 5, each hair-pulling element 13 is provided with a thickened end portion 20 which achieves that the distance between the contact edge 16 of the it would be air-pulling element 13 and the cutting edge 9 of the cutter element 8 will be greater than without the thickened end portion. The hair is accordingly pulled over a greater distance into the hair-trapping opening 5, and is accordingly cropped shorter.

FIG. 6 shows the hair-pulling member 7 in planar shape, obtained in a process of shaping the outline, usually a stamping or cutting process. The hair-pulling member is formed by a central portion 21 with a plurality of arms at the circumference thereof, which arms form the hair-pulling elements 13. According to the invention, the thickened end portion 20 is obtained in that the end portion 22 of each hair-pulling element 13 is provided with a lateral tab 23 during the stamping process, which tab is subsequently made to lie against the end portion 22 of the hair-pulling element 13 through bending along a bending line 24, as shown with a dash-dot line. FIG. 7 shows the end of the hair-pulling element after the bending process in detail. Preferably, a slotted opening 25 is stamped out between the end portion 22 of the hair-pulling element 13 and the lateral tab 23, which opening extends up to the contact edge 16. The portion 26 over which the tab 23 is doubled over is made smaller thereby. The bending process is easier, smaller forces are required, and the contact edge 16 is not damaged.

FIG. 8 shows a second example in which a tab 123 is formed at the end portion 122 of the hair-pulling element 113. An opening 126 is stamped in the end portion 122 in the cutting process, such that the tab 123 is formed in the opening during the cutting process, which tab is separated from the end portion 122 on either side by a slot 125 and is connected to the end portion at one side. The side of the tab connected to the end portion forms the bending line 124 along which the tab is doubled over, as indicated with a dash-dot line. The tab 123 and the end portion 122 together form the thickened end 120 of the hair-pulling element 113.

FIG. 9 shows a third example with a tab 223 being formed at the end portion 222 of the hair-pulling element 213. The tab 223 is formed on both sides of the end portion 222 of the hair-pulling element, partly separated from the end portion by slots 225. The tabs 223 are doubled over along the bending lines 224 and thus form together with the end portion 222 the thickened end 220 of the hair-pulling element 213.

What is claimed is:

1. A method of manufacturing a blade-shaped hair-pulling element for a cutting unit of a shaving apparatus, which cutting unit is provided with an external cutting member and an internal cutting member which can be driven with respect to the external cutting member, said internal cutting member having cutter elements which are provided with cutting edges, while said external cutting member is provided with a wall portion with hair-trapping openings which are bounded by counter cutting edges for cooperation with the cutting edges of the drivable cutter elements, each cutter element being provided with a blade-shaped hair-pulling element, each blade-shaped hair-pulling element being in frontmost position, as seen in the drive direction, and being moveable relative to the associated cutter element during operation of the shaving apparatus from and towards the wall portion of the external cutting member, each blade-shaped hair-pulling element being provided with a thickened end with an edge which during operation of the shaving apparatus comes into contact with a hair projecting through the hair-trapping opening and pulls this hair further through the hair-trapping opening before said hair is cut off through the cooperation of the cutting edge and the counter cutting edge, said method of manufacturing said blade-shaped hair-pulling element comprising the steps of shaping its outline, followed by bending, characterized in that during the step of shaping the outline, the blade-shaped hair-pulling element is provided with at least one tab, and further characterized in that during the step of bending of the blade-shaped hair-pulling element, the at least one tab is bent against an end portion of the blade-shaped hair-pulling element, thus forming said thickened end.

2. A method as claimed in claim 1, characterized in that a narrow opening continuing up to said edge of the hair-pulling element is stamped out between an end portion of the hair-pulling element and the tab during the stamping process.

3. A cutting unit of a shaving apparatus, which cutting unit is provided with an external cutting member and an internal cutting member which can be driven with respect to the external cutting member, said internal cutting member having cutter elements which are provided with cutting edges while said external cutting member is provided with a wall portion with hair-trapping openings which are bounded by counter cutting edges for cooperation with the cutting edges of the drivable cutter elements the cutting unit provided with a blade-shaped hair-pulling element obtained by the method as claimed in claim 1 or 2.

4. A shaving apparatus provided with a cutting unit as claimed in claim 3.

* * * * *